United States Patent [19]

Calder

[11] 4,074,857

[45] Feb. 21, 1978

[54] REVERSIBLE SPRAY TIP

[76] Inventor: Oliver J. Calder, 1205 E. Madison, Orange, Calif. 92667

[21] Appl. No.: 765,809

[22] Filed: Feb. 4, 1977

Related U.S. Application Data

[63] Continuation of Ser. No. 622,633, Oct. 15, 1975, abandoned.

[51] Int. Cl.[2] ..... B05B 15/02; B05B 15/04

[52] U.S. Cl. ..... 239/119; 239/288.3; 239/600

[58] Field of Search ..... 239/119, 288, 288.3, 239/288.5, 390–393, 397, 587, 600–602

[56] References Cited

U.S. PATENT DOCUMENTS

| | | | |
|---|---|---|---|
| 2,755,137 | 7/1956 | Hughf | 239/288.5 |
| 2,971,250 | 2/1961 | Wahlin | 239/601 X |
| 3,116,882 | 1/1964 | Vork | 239/391 X |
| 3,447,756 | 6/1969 | Lawrence, Jr. | 239/601 X |
| 3,563,463 | 2/1971 | Walker | 239/119 |
| 3,593,920 | 7/1971 | Watson | 239/119 |
| 3,667,681 | 6/1972 | Blancha | 239/602 X |
| 3,952,955 | 4/1976 | Clements | 239/288.5 |

*Primary Examiner*—Bruce H. Stoner, Jr.
*Assistant Examiner*—Andres Kashnikow
*Attorney, Agent, or Firm*—Fulwider, Patton, Rieber, Lee & Utecht

[57] ABSTRACT

There is disclosed a reverisble spray tip assembly useful for airless sprayers and the like which has the spray tip member mounted in a barrel housing with distal portions of equal lengths and diameters and medial rim means of greater diameter. The assembly is secured to the discharge of a spray gun and the like with a retainer but that holds the assembly in a spraying position with the spray tip member directed to discharge a spray pattern from the gun and in a reversed position with the spray tip member seated against the barrel of the spray gun to permit discharge of the liquid in a reverse direction through the spray tip member, thereby cleaning the member. The assembly is provided with at least one flat chordal surface on the forward distal portion which is indexed to the orifice of the spray tip member to permit alignment of the spray tip member after securing the retaining nut and assembly to the barrel of the spray gun. In a preferred embodiment, the retaining nut and spray tip assembly are combined with a spray guard which has a cylindrical portion for receiving the retaining nut with an aperture bearing a flat chordal surface for securing the flat spray pattern tip assembly against rotation with respect to the guard, permitting adjustment of spray pattern to desired orientation by rotating the guard and an antifriction bearing is provided to facilitate the rotational adjustment.

5 Claims, 3 Drawing Figures

REVERSIBLE SPRAY TIP

REFERENCE TO RELATED APPLICATIONS

This application is a continuation of parent application Ser. No. 622,633, filed on Oct. 15, 1975 and now abandoned.

BACKGROUND OF THE INVENTION

1. Field of Invention

This invention relates to a spray tip assembly useful in airless spray equipment and in particular relates to a spray tip assembly that is reversible for cleaning.

2. Description of the Prior Art

Airless sprayers are employed to spray paints and similar liquids in a precise spray pattern. The sprayers are operated at high pressures to force the liquid through a minute orifice which is cut into a spray tip member that is typically formed of tungsten carbide or a similar wear resistant material. A difficulty encountered in this spraying system is that any solids in the liquid are forced into the orifice of the spray tip member and are trapped therein, clogging its orifice. If spray tip member is reversed in the assembly, the high pressure liquid can be used to blow the obstruction from the clogged orifice and a number of devices have been designed to facilitate the reversal of the spray tip member for this cleaning operation. Typical of these is the turret nozzle unit described in U.S. Pat. No. 3,116,882, in which the spray tip member is mounted in a spherical housing between compressed seals to permit its rotation for reversal of the spray tip member. Another design is shown in U.S. Pat. No. 3,563,463, in which the spray tip member is carried in a cylindrical housing that is secured to an adaptor on the end of the spray gun by a collar having a transverse slot to permit the spray tip member to be removed and reversed in its position. Another solution is that shown in U.S. Pat. No. 3,460,757, in which the spray tip member is carried in a housing having an externally threaded forward portion. An adaptor is provided which can be turned onto the threaded barrel of the spray gun to couple the spray tip assembly to the spray gun in its reverse direction.

I have disclosed in a prior patent, U.S. Pat. No. 3,831,862, the mounting of the spray tip member in a reversible housing with a bolt action lock to facilitate the removal and reversal of the spray tip for cleaning.

A difficulty encountered with most prior designs which permit reversing the spray tip member on the spray gun is that the devices require a substantial number of parts, resulting in a greater initial cost and/or a higher maintenance requirement. Additionally, many of the prior art devices are not entirely foolproof in operation and require special training or instructions.

It is, therefore, desirable to provide a spray tip assembly which is reversible in a spray gun mounting having a minimal number of parts and which can be used with a minimal amount of instructions.

BRIEF STATEMENT OF THE INVENTION

This invention comprises a reversible spray tip assembly in which the spray tip member is mounted in a barrel housing with an annular sealing member and cylindrical plug member to secure the assembly. The assembly is provided with distal cylindrical portions of equal lengths and diameters and a medial rim means of greater diameter. The assembly is employed in combination with a retainer nut having a flat annular face for receiving either of the distal cylindrical portions and an annular lip for retaining the medial rim means of the assembly, thereby permitting the sealed engagement of the spray tip assembly against the end of the spray gun. The forward distal cylindrical portion of the spray tip assembly bears at least one flat, chordal surface which is oriented to the discharge orifice of the spray tip member thereby permitting the facile alignment of the spray tip assembly during its mounting to the spray gun. In a preferred embodiment, a spray guard is also employed in combination with the retaining nut and spray tip assembly. The spray guard has flat parallel faces which can be aligned to the spray pattern of the assembly. To permit the alignment, the spray guard has a central aperture to receive the forward end of the spray tip assembly and this aperture is provided with at least one flat chordal surface to index the spray guard to the spray tip assembly. The spray guard is provided with a sleeve portion that overlies the retaining nut and with internal detent means to interlock with an annular groove on the retaining nut and secure the spray guard to the retaining nut.

BRIEF DESCRIPTION OF THE DRAWINGS

The presently preferred embodiment of the invention is shown on the drawings of which.

DESCRIPTION OF PREFERRED EMBODIMENTS

Figure 1:
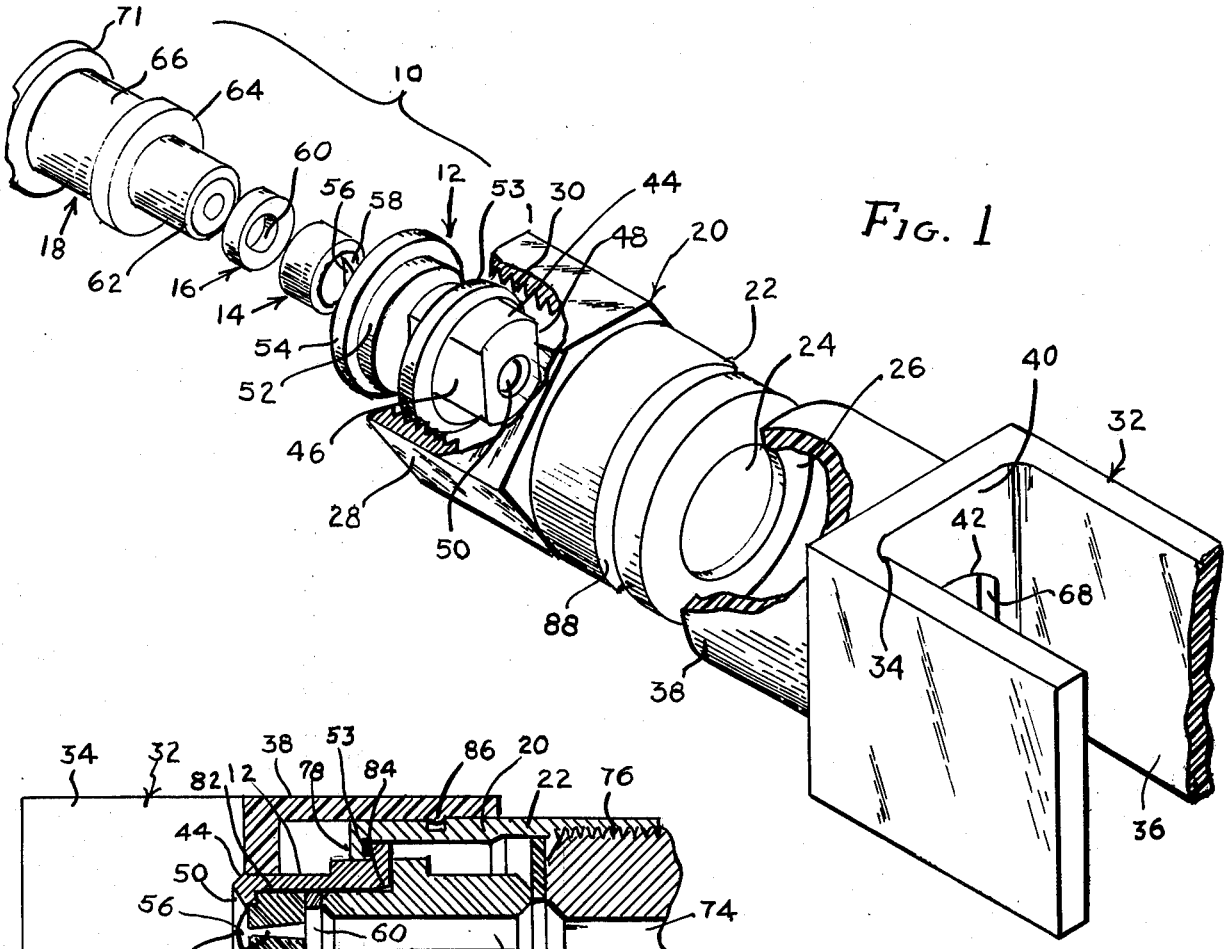
FIG. 1 is an exploded perspective view of the invention.

Referring now to FIG. 1, the invention is shown as comprising a reversible spray tip assembly generally indicated at 10 and comprising an assembly of a barrel member 12, a spray tip member 14, a sealing member 16 and a generally cylindrical plug member 18. The spray tip assembly 10 is received within a retainer nut member 20 having a cylindrical forward end 22 with an aperture 24 in its front face 26 and a generally hexagonally shaped rear portion 28 bearing internal threads 30.

The invention can also include a spray guard member which is generally shown at 32 and which comprises a forward portion defined by opposite parallel plates 34 and 36 extending from a rear cylindrical portion 38 which has a sufficient internal diameter to receive the forward cylindrical end 22 of retainer nut 20. The transverse web 40 of guard 32 bears a central aperture 42 to receive the forward end of barrel 12 as described hereinafter.

Barrel 12 has forward distal portion 44 which is generally cylindrical and which bears at least one flat chordal surface such as 46. In the preferred embodiment two parallel and opposite chordal surfaces are provided such as 46 and 48. The front face of barrel 12 has a central aperture 50 and the opposite end bears rim means in the form of a first rim 52 and second rim 54 of successively greater diameters. Antifriction washer 53 which can be formed of a plastic such as Delrin, Nylon, Teflon, etc., seats in nut member 20 about rim 52 to provide a low frictional contact that will permit facile rotation of spray tip assembly 10 after the device is installed on a spray gun.

The spray tip member 14 is of conventional design and configuration and barrel 44 has a sufficient internal diameter to receive the spray tip member 14. The member 14 is formed of cylindrical stock of a suitable wear resistant material such as tungsten carbide and the like. The front face of the spray tip member 14 bears a hemispherically shaped dome 58. A through passageway in the form of a tapered bore extends from the rear face of the spray tip member 14 and communicates with a transverse slot 56 across the dome 58 of this member.

The spray tip assembly 10 also includes seal means 16 in the form of a resilient annular washer having an outer diameter substantially equal to that of spray tip member 14 and an internal aperture 60 which permits fluid communication with the through passageway of the spray tip member 14.

Plug member 18 has a forward portion 62 with an outside diameter of substantially the same dimensions as the inside diameter of barrel 44. Preferably, the outside diameter of portion 62 is slightly greater, e.g., from 0.001 to about 0.005 inch, than the inside diameter of barrel 44 to permit plug 18 to be press-fitted into barrel 12. The plug 18 has a medial rim 64 which is of the same diameter and width as rim 52 of barrel 12 and a rear distal portion 66 which is cylindrical and of the same outside diameter and length as forward distal portion 44 of barrel 12. Spray tip member 14 is pressed against the interior front wall of barrel 12 with dome 58 extending through aperture 50. Washer 60 is compressed against the rear face of spray tip member 14 and the forward annular face of plug member 18, sealing the through passageway in the assembly. The annular rim 64 of plug member 18 butts against annular rim 54, thereby providing an assembly 10 of symmetrical exterior dimensions.

The forward distal portion 44 of the orifice tip assembly 10 projects through aperture 24 of the retainer nut 22 and through aperture 42 of the spray guard member 32. The orifice 42 of the latter is provided with flat chordal surfaces such as 68 which mate with the flat chordal surfaces 46 and 48 of the forward distal portion 44 of the orifice tip assembly, thereby indexing the parallel plates 34 and 36 to the angular position of the orifice tip assembly.

The orifice tip assembly houses orifice tip member 14 in a predetermined alignment. In this alignment the transverse slot 56 which intersects dome 58 of orifice tip member 14 is aligned parallel to the flat chordal surfaces 46 and 48. The slot 56 in dome 58 provides a flat spray pattern which exits from the orifice tip member 14 substantially parallel to the flat chordal surfaces 46 and 48. The guard plates 34 and 36 are also aligned parallel to the flat spray pattern.

Figure 2:
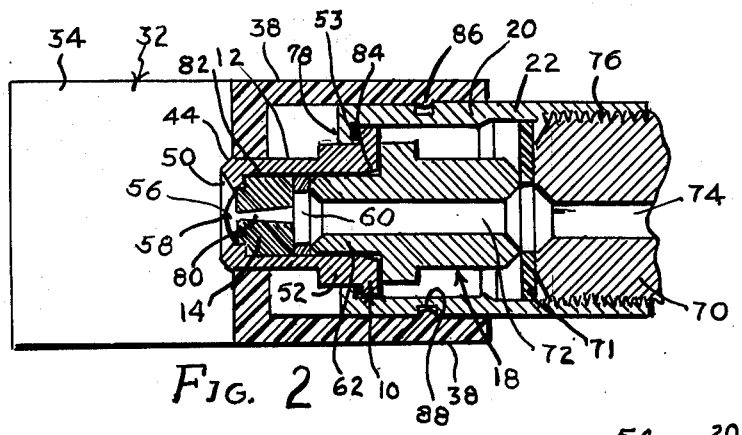
FIG. 2 illustrates the invention as it is secured to a spray gun in its spraying position.

Referring now to FIG. 2, the invention is shown attached to a barrel 70 of a conventional spray gun. The through passageway 74 of the spray gun barrel is shown in communication with the through passageway 72 of the assembly 10. A sealing washer 71 is secured between the spray barrel and end of spray tip assembly 10. This washer is preferably also formed of a plastic having a low frictional coefficient. Retainer nut 22 is secured with its internally threaded end 76 turned onto the threaded end of the spray gun barrel 74 to compress the assembly 10 against low friction seal 71 on the front face of the barrel with its front annular lip 78 bearing against the antifriction washer 53 on rim 52 of assembly 10. As shown in FIG. 2, the spray tip member 14 has a tapered through passageway 80 extending to dome 58 which is intersected by transverse groove 56. The hemispherical tip 58 of the spray tip member 14 projects through the central aperture 50 of the forward distal portion 44 of assembly 10. To avoid interference with the spray pattern, the leading face of orifice 50 is bevelled at approximately 60 degrees to the axis of the assembly.

Barrel 12 of the assembly 10 is shown with a central through passageway 82 which receives the spray tip member 14, sealing washer 16 and the forward portion 62 of plug member 18. The rear face of barrel 44 has an annular champer 84 about through passageway 82 to facilitate the press-fitting of plug 18 into the assembly. Guard member 32 surrounds the assembly with its cylindrical portion 38 overlying the cylindrical end 22 of the retaining nut 20. In this position, detents 86 carried on the inner periphery of the cylindrical portion 38 of the guard member seat within the square annular groove 88 that extends about the periphery of the cylindrical portion 22 of retaining nut 20. The detents 86 comprise convex shaped nodules or protrusions on the interior surface of the wall of the cylindrical portion 38 of the guard member. This member can be formed of suitable plastics such as: polypropylene, Nylon, Delrin, ABS resins, etc. The guard member 32 has sufficient resiliency to permit cylindrical portion 38 to be pressed over the end of retaining nut 20 and the detents 86 to snap into the square groove 88. Once the detents have seated in groove 88, the sharp edged walls of this square groove secure the guard member 32 against dislodgement by preventing the detents from deforming sufficiently to slip over the retained end of the nut member 28.

The guard member 31 as thus illustrated provides a facile means for alignment of the spray member 14, and its resultant spray pattern on the spray gun barrel 70. The guard 32 is free to rotate on nut member 20 during flat spray orientation. Spray tip assembly 10 cannot rotate in guard member 32 since the flat annular faces such as 68 of aperture 42 engage the flat chordal surfaces 46 and 48 of the forward distal portion 44 of the spray tip assembly 10. In this fashion, the spray pattern from the device is aligned parallel to the opposite plates 34 and 36 of the guard 32 and can be aligned at any predetermined angular orientation to the spray gun of the apparatus.

Figure 3:
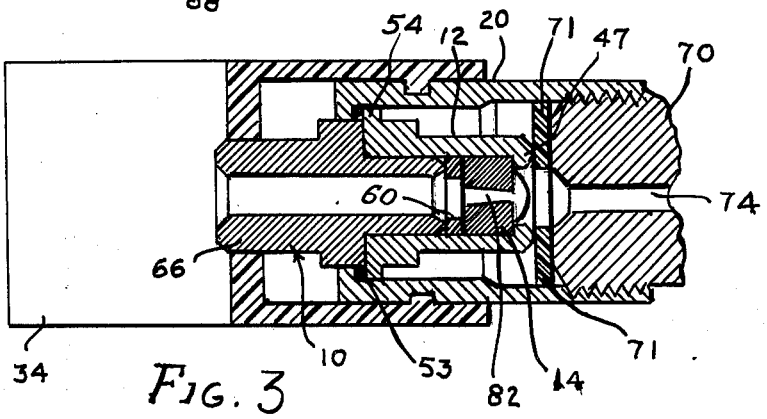
FIG. 3 illustrates the invention with the spray tip assembly reversed for cleaning.

FIG. 3 illustrates the spray tip assembly in its reversed position for cleaning. This position is arrived at from the operating position shown in FIG. 2, by loosening and removing retaining nut 20 from barrel 70 of the spray apparatus. The spray tip assembly 10 is then removed from the retaining nut, reversed end-for-end and reinserted into the retaining nut in the alignment shown in FIG. 3. The retaining nut is thereafter tightened on the externally threaded barrel 70 to secure the forward annular face 47 of the assembly 10 against a low friction washer 71 the discharge face of barrel 70, sealed thereto by the compression of retaining nut 20 against the antifriction washer 53 which bears against medial rib 54 of the assembly. In this position, solid material which becomes lodged within the through passageway 82 of spray tip member 14 can be readily dislodged by the liquid received under pressure from barrel 70 of the spray gun.

The invention has been described with reference to the presently preferred embodiments thereof. It is not intended that the invention be unduly limited by the description and illustration of presently preferred embodiments. Instead, it is intended that the invention be defined by the means and their obvious equivalents set forth in the following claims.

What is claimed is:

1. A spray tip assembly for reversible mounting in a spray gun that comprises:

(1) a cylindrical barrel housing having a forward end bearing at least one chordal flat, first and second outer rims of successively greater diameters at its opposite end to provide a large diameter rear face, and a bevelled aperture in its forward end opening to a larger diameter axial counterbore;

(2) a spray tip member received in said counterbore with its discharge end having a transverse spray discharge slot projecting through said aperture and aligned to said chordal flat;

(3) a cylindrical plug member having a first end of the diameter of said counterbore and received in a press fit therein, an outer medial rim of a diameter and width of said first rim, and an opposite end of a length equal to said forward end of said barrel housing; and (4) an annular sealing member; said sealing member received in said counterbore and compressed between the received end of said plug member and the rear face of said spray tip member with the medial rim of said plug member butted against the rear face of said barrel housing.

2. The spray tip assembly of claim 1, wherein said forward end of said barrel housing has a pair of parallel chordal flats.

3. The spray tip assembly of claim 1, wherein said spray tip member is formed of a tungsten carbide cylinder with a hemispherically shaped dome having said transverse slot.

4. A spray gun assembly having a spray gun with a barrel for the discharge of pressure fluid therefrom and bearing a threaded boss, retainer nut means threaded thereon and having an appertured front face, the spray tip assembly of claim 1 received within said retainer nut means with its forward end projecting from said apertured front face, guard means rotationally mounted on the fore end of said said retainer nut means and having flat parallel wings and a central bore with at least one chordal flat to receive the forward end of said spray tip assembly, thereby orienting the wings of said guard means to the orifice of said spray tip member and parallel to the flat spray pattern produced therefrom, and first and second anti-friction washer means formed of low frictional coefficient plastic and mounted respectively between the discharge end of said gun assembly barrel and said spray tip assembly and between said medial rim of said spray tip assembly and said retainer nut means to permit rotation of said housing upon rotation of said guard means.

5. The combination of claim 4 wherein said guard means includes dependent sleeve means to receive said retainer nut means and including detent means operative to engage mating recess means on the periphery of said retainer nut means.

* * * * *